US007193207B1

(12) United States Patent
Ding et al.

(10) Patent No.: US 7,193,207 B1
(45) Date of Patent: Mar. 20, 2007

(54) METHODS AND APPARATUS FOR DRIVING A QUADRUPOLE ION TRAP DEVICE

(75) Inventors: Li Ding, Manchester (GB); James Edward Nuttall, Rossendale (GB)

(73) Assignee: Shimadzu Research (Europe) Ltd., Manchester (GB)

( * ) Notice: Subject to any disclaimer, the term of this patent is extended or adjusted under 35 U.S.C. 154(b) by 488 days.

(21) Appl. No.: 10/089,963

(22) PCT Filed: Oct. 16, 2000

(86) PCT No.: PCT/GB00/03964

§ 371 (c)(1),
(2), (4) Date: Jun. 24, 2003

(87) PCT Pub. No.: WO01/29875

PCT Pub. Date: Apr. 26, 2001

(30) Foreign Application Priority Data

Oct. 19, 1999 (GB) ..... 9924722.3

(51) Int. Cl.
*H01J 49/42* (2006.01)

(52) U.S. Cl. ..... 250/292; 250/282

(58) Field of Classification Search ..... 250/292
See application file for complete search history.

(56) References Cited

U.S. PATENT DOCUMENTS

| | | | |
|---|---|---|---|
| 2,939,952 A | 6/1960 | Paul et al. | |
| 4,540,884 A | 9/1985 | Stafford et al. | |
| 4,736,101 A | 4/1988 | Syka et al. | |
| 4,761,545 A | 8/1988 | Marshall et al. | |
| 5,134,286 A | 7/1992 | Kelley | |
| 5,206,506 A | 4/1993 | Kirchner | |
| 5,625,186 A | 4/1997 | Frankevich et al. | |
| 5,629,186 A | 5/1997 | Yasukawa et al. | |
| 6,900,433 B2 * | 5/2005 | Ding | 250/292 |

FOREIGN PATENT DOCUMENTS

| | | |
|---|---|---|
| GB | 773689 | 5/1957 |
| GB | 1059599 | 2/1967 |
| GB | 1346393 | 2/1974 |
| SU | 1088090 | 4/1984 |

OTHER PUBLICATIONS

Sheretov et al., Opportunities for Optimization of the RF Signal Applies to Electrodes of Quadrupole Mass Spectrometers. Part II EC Signals, International Journal of Mass Spectrometry, Apr. 2000, pp. 97-111 vol. 198 No. 1-2, Elsevier Science Publishers, Amsterdam, NL.

(Continued)

*Primary Examiner*—David Vanore
(74) *Attorney, Agent, or Firm*—Leydig, Voit & Mayer, Ltd.

(57) ABSTRACT

A digital drive apparatus (FIG. 3) for quadrupole device such as a quadrupole ion trap has a digital signal generator (11, 13, 14; 24, 25, 26) and a switching arrangement (16, 17) which alternately switches between high and low voltage levels ($V_1$, $V_2$) to generate a rectangular wave drive voltage. A dipole excitation voltage is also supplied to the quadrupole device to excite resonant oscillatory motion of ions.

30 Claims, 6 Drawing Sheets

OTHER PUBLICATIONS

Schlunegger et al., Frequency Scan For the Analysis of High Mass Ions Generated by Matrix-Assisted Laser Desorption/Ioniziation in a Paul Trap, Rapid Communications in Mass Spectrometry, 1999, pp. 1792-1796, vol. 13, London, GB.

Shertov et al., Theory of the Pulsed Quadrupole Mass Spectrometer, Soviet Physics Technical Physics., 1972, pp. 755-760, vol. 17 No. 5, New York, U.S.A.

Richards et al., A New Operating Mode for the Quadrupole Mass Filter, International Journal of Mass Spectrometry, 1973, pp. 317-339, vol. 12 No. 4, Elsevier Science Publishers, Amsterdam, NL.

* cited by examiner

METHODS AND APPARATUS FOR DRIVING A QUADRUPOLE ION TRAP DEVICE

FIELD OF THE INVENTION

This invention relates to quadrupole mass spectrometry. In particular, the invention relates to methods and apparatus for driving a quadrupole ion trap device, such as a linear or 3D rotationally symmetric quadrupole ion trap device. The invention also relates to quadrupole devices using and incorporating said methods and apparatus.

BACKGROUND OF THE INVENTION

The original idea of using a quadrupole mass analyzer and a quadrupole ion trap for mass analysis was first disclosed by W. Paul and H. Steinwedel in U.S. Pat. No. 2,939,952. In general, two different electrode structures are used in quadrupole ion trap mass spectrometry; that is, the linear quadrupole ion trap structure and the 3D rotationally symmetric quadrupole ion trap structure, illustrated in FIGS. 1*a* and 1*b* respectively of the accompanying drawings. Referring to FIG. 1*a*, the linear quadrupole ion trap structure includes a pair of x-electrodes 1, a pair of y-electrodes 2, an ion entrance plate 3 and an ion exit plate 4. Both plates 3,4 can be used to set a potential barrier to prevent ions from escaping. Referring to FIG. 1*b*, the quadrupole ion trap structure includes a ring electrode 1, and end cap electrodes 2,3, there being a central hole 4 in end cap electrode 2. To make these structures function as mass analyzers, a voltage having a periodic variation as a function of time needs to be applied across the electrodes. U.S. Pat. No. 2,939,952 teaches a method of generating a sinusoidal high frequency voltage combined with a DC voltage to achieve this periodic voltage. Upon application of such a voltage a quadrupole electric field that drives the ions' motion is set up. The theory of ion motion based on the solution of Mathieu's equation was established. This theory has been widely used by others in later developments of quadrupole mass spectrometry and introduced in the related text book "Quadrupole Storage Mass Spectrometry" by E. March, R. J. Hughes, Wiley—Interscience Publication where the sinusoidal high frequency voltage is usually referred to as a radio frequency (RF) voltage.

There were many technical advances of ion trap mass spectrometry in the 1980's. Among them, operation in mass selective instability mode disclosed in U.S. Pat. No. 4,540,884 and use of mass selective resonance ejection disclosed in U.S. Pat. No. 4,736,101 led to significant improvements in the performance of a quadrupole ion trap enabling the device to carry out fast and high resolution mass analysis and tandem mass analysis.

Different methods of detection such as Fourier transform of image current disclosed in U.S. Pat. No. 5,629,186 were also developed later. These developments have brought about tremendous applications in mass spectrometry and in the combination of mass spectrometry with other widely used instrumentation.

Because, fundamentally, this technology is based on ion motion in the superimposed RF and DC quadrupole electric fields, or in some cases in a pure RF electric field, all applications need an RF power source to supply RF voltage to the quadrupole devices. Conventionally, a RF power supply comprises a driving electric circuit and a resonating network which includes the quadrupole ion optical device as a load. The resonant frequency of the network is normally fixed or has a small number of fixed values. To achieve mass scanning or mass selection, the output voltage of the RF power supply must be able to ramp up and down precisely according to the desired scheme, the amplitude of the RF voltage being proportion to mass-to-charge ratio when the RF frequency is fixed. A high RF voltage is necessary for high mass analysis. Also, sometimes an undesirable shift in the resonance position of the network caused by a change in output voltage needs to be corrected. These factors have resulted in increased costs and complexity of instruments.

A paper entitled "Frequency Scan for the Analysis of High Mass Ions Generated by Matrix-assisted Laser Desorption/Ionization in a Paul Trap" by U. P. Schlunegger et al, Rapid. Commun. Mass. Spectrom. 13, 1792–1796 (1999) discloses use of a frequency scanning technique instead of a voltage scanning technique to improve the mass scanning range of a quadrupole ion trap of a MALDI ion trap spectrometer. The described technique is particularly suitable for trapping and analysing biomolecular ions which have high mass-to-charge ratio. A waveform generator and a power amplifier were used to provide the frequency-variable sine wave voltage. This voltage output is limited by the power consumption of the amplifier which is basically an analogue circuit and has to work in a linear state. Therefore, when a higher trapping RF voltage is needed, it is difficult to reduce the power consumption, and so the machine size and production cost with this configuration.

It is in fact not necessary to use a sinusoidal RF voltage to drive a quadrupole ion trap or a quadruople mass analyser as stated by W. Paul etc in their original disclosure. E. P. Sheretov et al in their paper "Basis of the theory of quadrupole mass spectrometers during pulse feeding" Zh. V. I Terent'ev, Tech. Fiz (1972), 42(5) 953–962 have given some detailed discussion on ion behaviour in the quadrupole mass spectrometer upon applying voltage pulses. GB 1346393 has even disclosed methods of driving a quadrupole mass filter with a rectangular or trapezoidal wave voltage. However, the real advantage of rectangular wave driving is associated with digital frequency scanning and timing control. This was not revealed by the previous art. The particular method combined with the rectangular wave driving of the quadrupole ion trap to achieve high performance MS and $MS^n$ has not yet been provided.

The method of this invention utilizes a time-varying rectangular wave voltage applied to a quadrupole ion trap device for ion trapping, selection, and/or mass analyzing.

SUMMARY OF THE INVENTION

According to one aspect of the invention there is provided a method for driving a quadrupole ion trap device including creating a digital signal, using the digital signal to control a set of switches to cause the switches alternately to switch between a high voltage level and a low voltage level to generate a time-varying rectangular wave voltage, supplying the time-varying rectangular wave voltage to the quadrupole ion trap device to trap ions in a predetermined range of mass-to-charge ratio, varying the digital signal to vary the predetermined range of mass-to-charge ratio of ions that can be trapped by the quadrupole ion trap device and further supplying to the quadrupole ion trap device a time-varying dipole excitation voltage to cause mass-selective resonant oscillatory motion of ions in the device.

According to another aspect of the invention there is provided an apparatus for driving a quadrupole ion trap device, means for creating a digital signal, a set of switches arranged to be controlled by said digital signal to cause the switches alternately to switch between a high voltage level and a low voltage level to generate a time-varying rectangular wave voltage which is supplied, in use, to said quadrupole ion trap device for trapping ions in a predetermined range of mass-to-charge ratio, means for varying said digital signal to vary the predetermined range of mass-to-charge ratio of ions that can be trapped by the quadrupole ion trap device and means for supplying to the quadrupole ion trap device a time-varying dipole excitation voltage to cause mass-selection resonant oscillatory motion of ions in the device.

The said quadrupole ion trap device may be an ion trapping system in a form of linear quadruople mass analyzer or a 3D rotationally symmetric quadrupole ion trap or any other ion trap structure that can be used to generate a quadruople electric field for storing and/or mass analyzing ions.

BRIEF DESCRIPTION OF THE DRAWINGS

Embodiments of the invention are now described, by way of example only, with reference to the accompanying drawings of which.

DESCRIPTION OF PREFERRED EMBODIMENTS

Figure 1A:
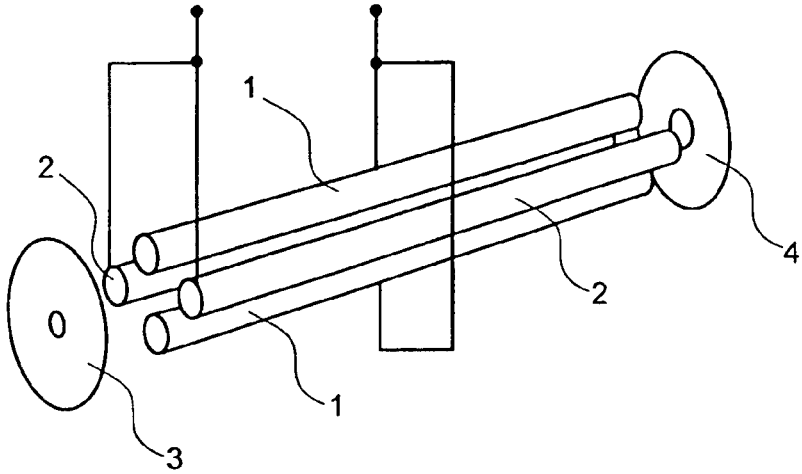
FIG. 1*a* shows a known linear form of quadrupole ion trap structure.
Figure 1B:
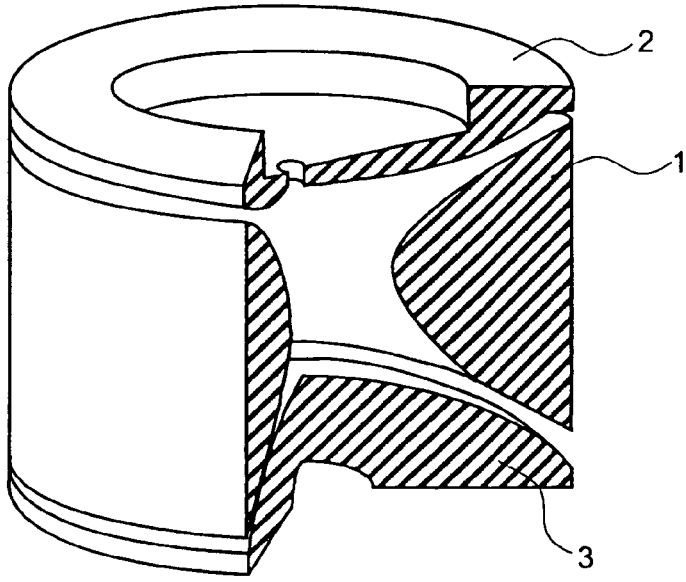
FIG. 1*b* shows a known 3-D rotationally-symmetric quadruople ion trapping structure.
Figure 2:
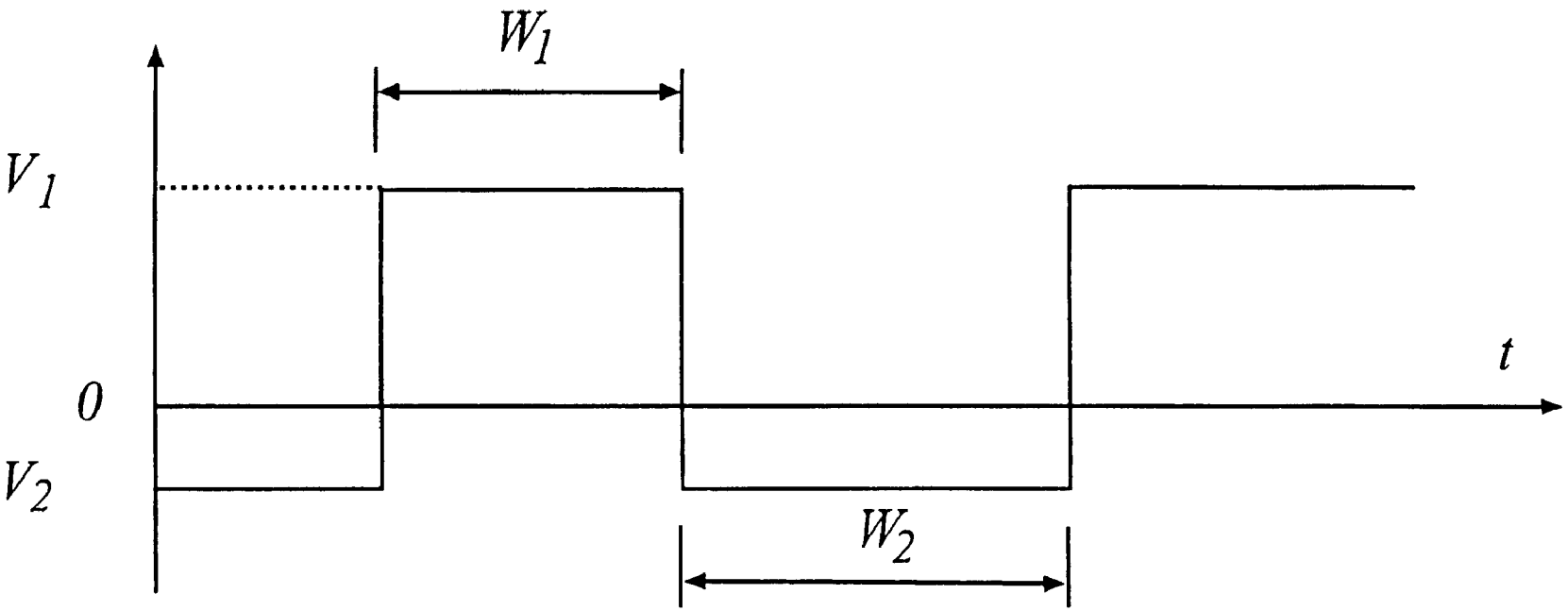
FIG. 2 shows a time-varying rectangular wave voltage in accordance with the invention.

The rectangular wave voltage shown in FIG. 2 has a width $w_1$ at a high voltage level $V_1$ and a width $w_2$ at a low voltage level $V_2$. In this example, the rectangular wave voltage has a DC offset U given by:

$$U=(w_1V_1+w_2V_2)/(w_1+w_2) \quad (1)$$

and a repetition rate f given by:

$$f=(w_1+w_2)^{-1} \quad (2)$$

Figure 3A:
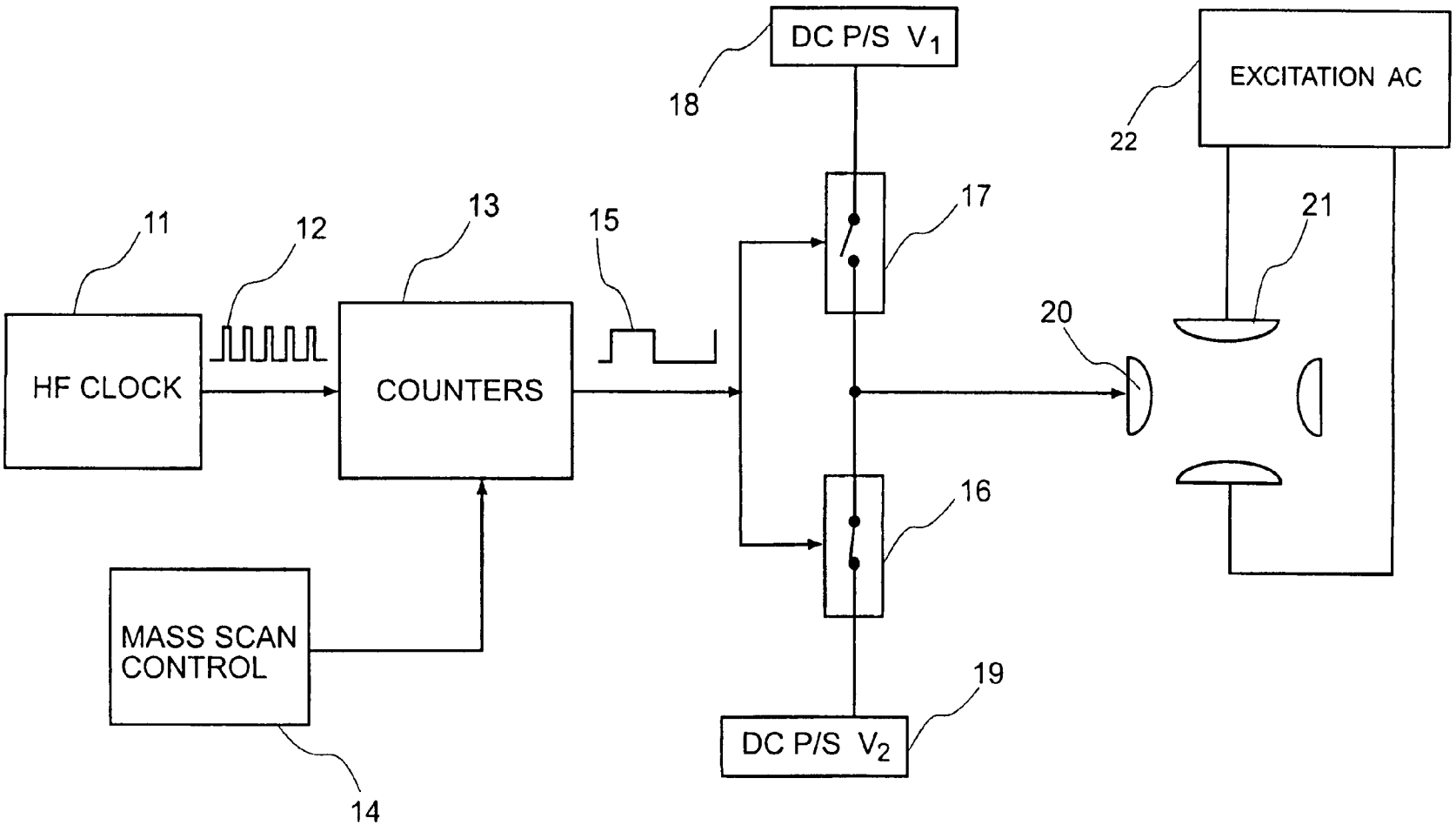
FIG. 3*a* is a block schematic diagram showing one embodiment of a drive apparatus according to the invention for use in a quadrupole ion trap.

FIG. 3*a* shows an example of a drive apparatus for generating the rectangular wave voltage of FIG. 2. The drive apparatus includes a clock 11 for generating a high frequency, high precision clock signal 12. A count unit 13 has a number of counters and an output gate which is set or reset according to a preset number of counts in each counter. The number of counters will depend on the complexity of the required rectangular wave pattern. In the illustrated example there are two counters which set or reset the output gate according to a preset number of counts $N_{w1}$,$N_{w2}$ which determine the widths $w_1$, $w_2$ of the rectangular wave pattern. A mass scan control unit 14 which sets the counts $N_{w1}$,$N_{w2}$ is programmed to control the output digital pattern and its variation during mass scanning i.e. scanning of the ions' mass-to-charge ratio.

The digital signal 15 having the required pulse pattern is then supplied to a switch circuit including switch 16 and switch 17. Switches 16 and 17 are typically bipolar or FET transistors. An adaption circuit between the count unit 13 and the switches 16,17 may be needed to overcome possible potential differences between the switches and to ensure that the switches operate at the required speed. Switch 16 is connected to a low level DC power supply 19 ($V_2$) and switch 17 is connected to a high level DC power supply 18 ($V_1$). When switches 16,17 are alternately opened and closed according to the digital control signal 15, the high and low level voltages $V_1$,$V_2$ which form the rectangular wave drive voltage will be supplied to the quadrupole device.

Figure 3B:
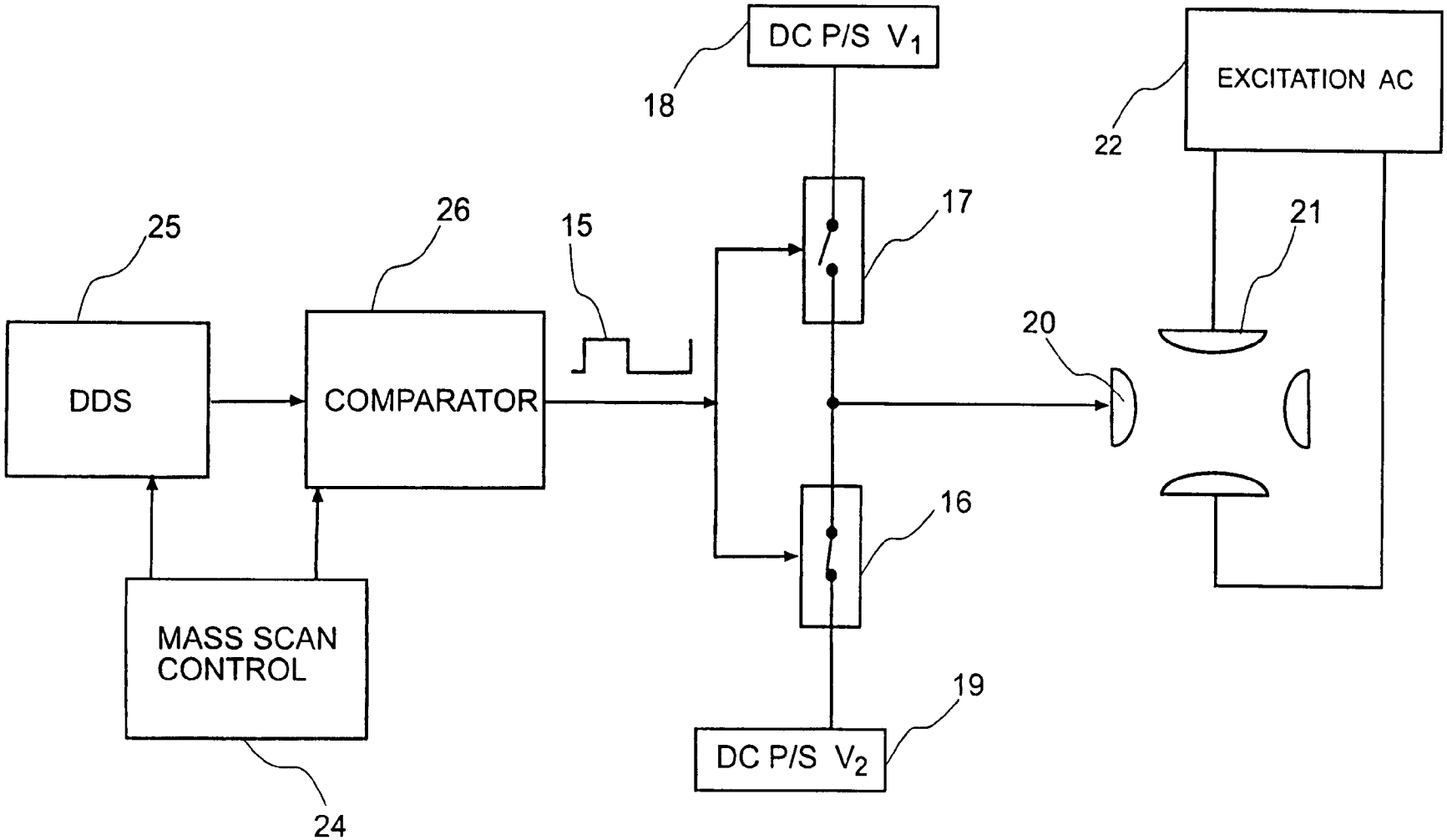
FIG. 3*b* is a block schematic diagram showing another embodiment of a drive apparatus according to the invention for use in a quadrupole ion trap.

FIG. 3*b* shows yet another example of driving apparatus for generating the rectangular wave voltage. This configuration differs from that of FIG. 3*a* by using a Direct Digital Synthesiser (DDS) 25 and fast comparator 26 to generate the digital control signal. The DDS 25 produces a periodic waveform of a certain frequency preset by the mass control unit 24, with considerably high accuracy. Through use of the fast comparator 26, the thresholds of which are set by the mass control unit in order to control duty cycle, the digital signal 15 is precisely generated and then used to control the switch circuit in the manner already described.

In order to further apply an additional dipole excitation electric field an AC excitation voltage source 22 is also used. The dipole excitation voltage may have a range of different AC waveforms, such as harmonic sinusoidal waveform, a broad-band multi frequency waveform or a rectangular waveform.

In the case of a quadrupole device in the form of a 3D quadrupole ion trap, the rectangular drive voltage is supplied to the ring electrode 20, and the end cap electrodes may be connected to the excitation voltage source 22 which may also provide a common DC bias for both end cap electrodes relative to the ring electrode. To produce a rectangular pulse to excite ion motion, the excitation voltage source may be also in the form of switch circuits, which are controlled by digital signals which have a predetermined relationship to the main digital signal 15.

In the simplest case, for which the rectangular wave voltage has a square waveform (i.e. $V_1=-V_2=V$, $w_1/w_2=1$), the DC power supply 19 may be set at a voltage having the same voltage as, but opposite polarity to, that of DC power supply 18. Alternatively, only a single DC power supply 18 is used and switch 16 is simply connected to ground. In this case, the resultant DC voltage offset can be cancelled out by applying a DC bias voltage $V_1/2$ to both end caps or by capacitively coupling the output voltage to the ring electrode 20 to isolate the DC offset.

In the case of a quadrupole device in the form of a linear quadrupole ion trap, the rectangular drive voltage is supplied to first pair of diagonally opposed electrodes and each of another pair of diagonally opposed electrodes is driven by a similar switch circuit of itself. The switchings for the second pair of diagonally opposed electrodes are normally synchronised and in anti-phase to the switching of the first pair to form a symmetric quadrupole field. However when their timings are deliberately controlled differently, a dipole excitation electric field is created and superimposed with the driving quadrupole field.

Driven by a rectangular wave voltage, ion motion in the quadrupole ion trap cannot be solved by Mathieu's equation which is fundamental to the afore-mentioned earlier theories of quadrupole mass spectrometry.

However, ion motion in a quadrupole field generated by a time-varying rectangular wave voltage can be defined by applying Newton's equation in different time segments. Within each segment the electric field is constant and so the equation can be easily solved.

The following is a brief illustration of an example of a theoretical derivation of ion motion.

Here, rectangular waveform of the form shown in FIG. 2 is applied to a standard quadrupole ion trap ($r_0=\sqrt{2}z_0$). For ease of illustration, it will be assumed that the waveform has no DC offset, so that V1=−V2=V, and it will also be assumed that $w_1/w_2=1$. This means that a voltage alternating between constant values of +/−V will be applied to the ring electrode of the ion trap during each half cycle. An ion's motion in the z direction is thus governed by the following differential equation: (Motion in r direction can be derived using a similar method, the two motions being independent)

$$\ddot{z} = \pm\frac{2eV}{r_0^2 m}z \tag{3}$$

A precise solution can be obtained both for the positive half cycle:

$$z=Ce^{\lambda t}+De^{-\lambda t} \tag{4a}$$

and for the negative half cycle:

$$z=G\cos(\lambda t)+H\sin(\lambda t) \tag{4b}$$

where C,D,G,H can be derived from the condition at the start of the half cycle and $$\lambda = \left(\frac{q_z}{2}\right)^{1/2}\Omega.$$

Here, $\Omega=2\pi f$ represents the rectangular wave repetition rate and $q_z$ has the same definition as for a conventional RF driven quadrupole ion trap for ease of comparison between the two types of motion i.e.

$$q_z = \frac{4eV}{m\Omega^2 r_0^2} \tag{5}$$

The trajectory of an ion can be calculated by alternatively using the two phase space transfer matrices:

$$\begin{bmatrix} z_{n+1} \\ \dot{z}_{n+1} \end{bmatrix} = \begin{bmatrix} ch(\lambda\pi/\Omega) & sh(\lambda\pi/\Omega)/\lambda \\ sh(\lambda\pi/\Omega)\lambda & ch(\lambda\pi/\Omega) \end{bmatrix} \begin{bmatrix} z_n \\ \dot{z}_n \end{bmatrix} \tag{6a}$$

for the positive half cycle, and $$\begin{bmatrix} z_{n+1} \\ \dot{z}_{n+1} \end{bmatrix} = \begin{bmatrix} \cos(\lambda\pi/\Omega) & \sin(\lambda\pi/\Omega)/\lambda \\ -\sin(\lambda\pi/\Omega)/\lambda & \cos(\lambda\pi/\Omega) \end{bmatrix} \begin{bmatrix} z_n \\ \dot{z}_n \end{bmatrix} \tag{6b}$$

for the negative half cycle.

Figure 4:
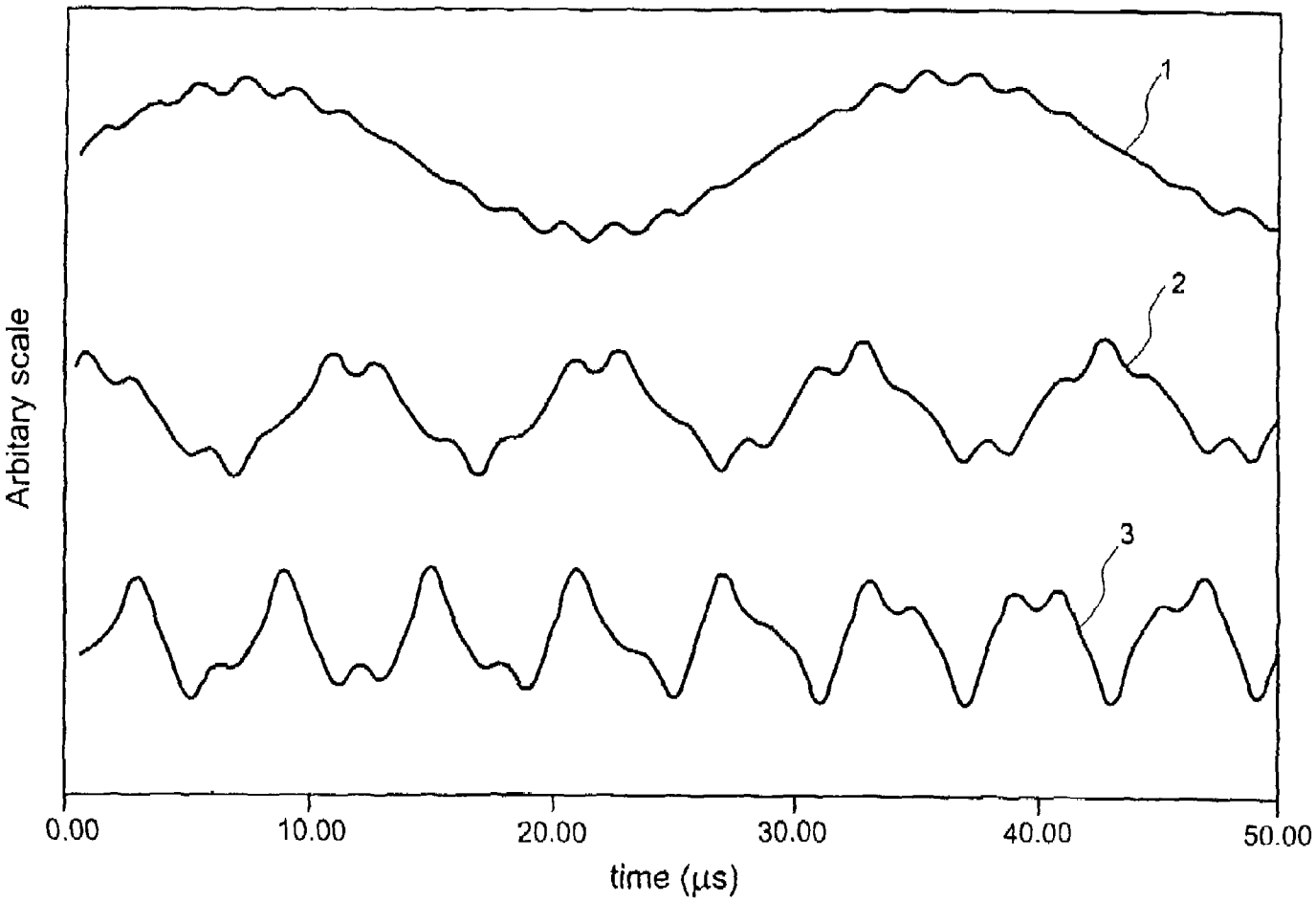
FIG. 4 shows the characteristics of ion motion in a quadrupole ion trap driven by different rectangular wave voltages.

The curves shown in FIG. 4 represent ion position as a function of time for motion in the z-direction obtained by numerical calculation based on the above matrix calculus. The curves referenced 1,2,3 in FIG. 4 are for $q_z$=0.15, 0.3 and 0.6 respectively, and it is clear that these values are in the range for bounded (or stable) ion motion.

If the rectangular wave voltage has a DC offset the parameter $a_z$ can also take the definition used for Mathieu's equation i.e.

$$a_z = -\frac{8eU}{m\Omega^2 r_0^2}.$$

Figure 5:
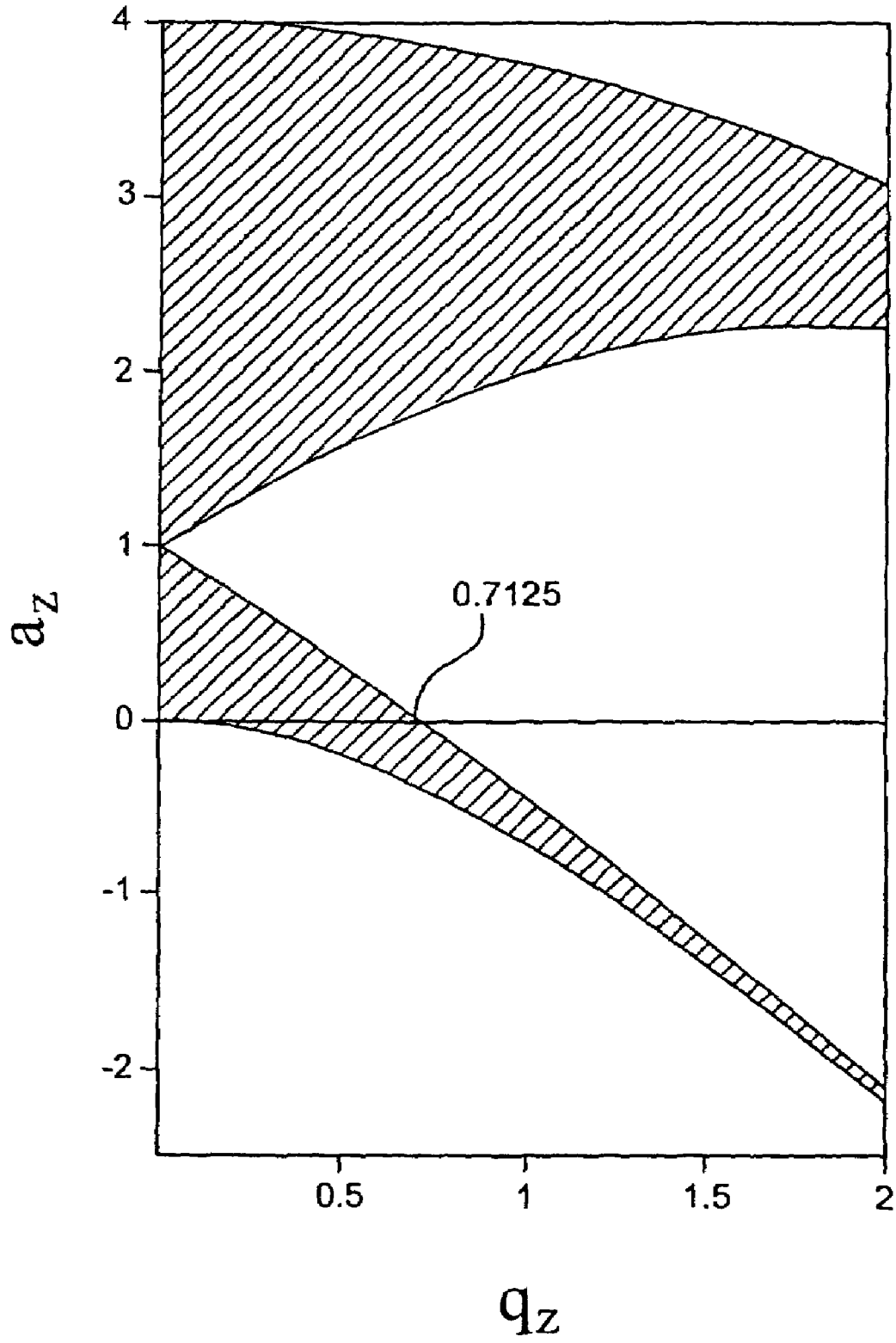
FIG. 5 illustrates the stable region (shown hatched) in a plot of a against q for ion motion in the z-direction only.

The a-q stability diagram is plotted in FIG. 5 for the case $w_1/w_2=1$ where the shaded areas indicate the values of $a_z$ and $q_z$ for which the motion of ions is stable. This shows that by applying the rectangular wave voltage, ions can be separated into ions undergoing stable motion and ions undergoing unstable motion enabling ions satisfying certain criteria to be stored inside the ion trap.

GB 1346393 and a paper by the same inventor have disclosed the method of choosing band-width of the stability region by varying the duty cycle of the rectangular wave and carrying out mass scanning by scanning the amplitude of the rectangular wave voltage. However, an alternative, more favourable method for mass selective scan does exist.

Although the detailed motion shown in FIG. 4 is complex, a major oscillation frequency for each curve can be clearly seen. A further theoretical study based on the theory presented in the above-mentioned paper by Sheretov et al shows that for smaller values of $q_z$ the angular frequency $\omega_z$ of this oscillation for the square wave case can be expressed as:

$$\omega_z = \frac{\Omega}{2\pi}\arccos\left[ch\left(\sqrt{\frac{q_z}{2}}\pi\right)\cos\left(\sqrt{\frac{q_z}{2}}\pi\right)\right] \tag{7}$$

For smaller values of $q_z$, this can be simplified to $$\omega_z - 0.45345 q_z \Omega \tag{8}$$

This frequency will be referred to as the intrinsic frequency of the ion motion. The oscillation at this frequency is caused by the integrated effect of the rectangular wave electric field, and its frequency is a function of mass-to-charge ratio and of the repetition rate of the driving rectangular wave voltage. Therefore, in the present invention an additional dipolar excitation voltage is used to cause ions having a selected mass-to-charge ratio to resonant at the intrinsic frequency $\omega_z$.

At or near resonance these ions can be selectively excited and even ejected from an ion trap so that they can be detected by an external detector. The resonant excitation also increases the kinetic energy of the selected ions and may promote certain chemical reactions or induce image current for Fourier transform detection.

One implementation of this resonance effect is now described by way of example using a conventional 3D quadrupole ion trap having holes in one or both end caps. The excitation AC voltage can be a single frequency, sinusoidal voltage or a rectangular wave voltage or a waveform composed of multi-frequency components. When this voltage is applied between the two end-caps and one of its frequency components $\omega_0$ approaches $\omega_z$, ion motion in the z direction will be resonantly excited. The oscillation amplitude of the resonant ions will increase until the ions reach the end-cap electrodes or are ejected through the end-cap holes. Because the intrinsic frequency $\omega_z$ is a function of mass-to-charge ratio, repetition rate f and the voltages defining the rectangular wave voltage, mass scanning using the desired resonance technique can be implemented in a variety of different ways:

1. Fix the repetition rate f of the driving rectangular waveform and scan the excitation frequency $\omega_0$ e.g. from 0 to $\pi f$.
2. Use a digital frequency divider to make the excitation frequency $\omega_0$ proportional to f, thereby fixing the value of $q_z$ and scan the repetition rate f. The repetition rate f can be varied by increasing or decreasing the values of $N_{w1}$, and $N_{w2}$ if the digital counting method is used to generate the digital control signal.
3. Fix the excitation frequency $\omega_0$ and scan the repetition rate f of the driving rectangular wave voltage. From equations (8) and (5) above it can be seen that $$\frac{m}{e} = \frac{1.814V}{r_0^2\omega_0}\Omega^{-1} \propto w_1 + w_2,$$

indicating that the mass scan can be made approximately linear by linearly increasing the setting of the rectangular wave period.

Although the above derivation is for a symmetric rectangular wave voltage where DC offset is zero, it will be appreciated that a finite DC offset and other rectangular waveform patterns are also within the scope of the invention. It will be understood that, in practice, the switching circuitry used to generate the rectangular wave voltage will have limited switching speed and will be subject to current limitation. Therefore, the rectangular waveform may have small rise and fall times. Although the voltages of the driving rectangular waveform were fixed during mass scanning, different mass scanning ranges can be obtained by using different voltages. Application of the rectangular wave voltage to drive the motion of ions in combination with broad band excitation where the frequency range is determined using equations (7) or (8) is also within the scope of the invention.

In the case of broad band excitation, a broad band waveform generator can still be used as was taught in U.S. Pat. Nos. 5,134,286 and 4,761,545.

In general, the rectangular wave voltage driven quadrupole mass spectrometry has the following merits compared with the current RF driven quadrupole mass spectrometry.

The rectangular wave voltage may be generated using a switching circuit which does not employ a LC resonator and so the frequency or the wave repetition rate can be easily changed. A practical range may be from 10 kHz to 10 MHz. It is known from the characteristics of ion motion in the quadrupole electric field that the range of mass scanning is made wider by varying frequency than by varying voltage within certain practical limits (for example discharge at high voltage).

A rectangular waveform can be defined using more parameters than is the case for a sinusoidal waveform e.g. amplitude, repetition rate, number of transitions within each cycle and their separations. These parameters provide more options for storing and manipulating ions. For example, the rectangular waveform pattern can easily be changed intermittently or temporarily during which time the ions from an external ion source can be introduced into the quadrupole device.

A switching circuit used to generate a rectangular wave voltage consumes less power than an untuned analogue circuit used to generate an RF drive voltage. This leads to a reduction in the power specification of the associated electronics.

There is currently a large number of advanced digital switching devices that will enable a rectangular waveform be generated with high precision and low cost. While the miniature or 'on chip' quadrupole mass analyzer or ion trap are under the development, a highly integrated drive circuit is also demanded. Using a fully digital driving signal to define a rectangular wave voltage can reduce circuit complexity and minimize the size and the cost of the device as well as the total cost of the instrument.

The invention claimed is:

1. A method for driving a quadrupole ion trap device including, creating a digital signal, using the digital signal to control a set of switches to cause the switches alternately to switch between a high voltage level and a low voltage level to generate a time-varying rectangular wave voltage, supplying the time-varying rectangular wave voltage to the quadrupole ion trap device to trap ions in a predetermined range of mass-to-charge ratio, varying the digital signal to vary the predetermined range of mass-to-charge ratio of ions that can be trapped by the quadrupole ion trap device and further supplying to the quadrupole ion trap device a time-varying dipole excitation voltage to cause mass-selective resonant oscillatory motion of ions in the device.

2. A method as claimed in claim 1 wherein said step of creating said digital signal includes:

generating clock pulses, counting the clock pulses and causing said switching when the count of clock pulses reaches respective preset values.

3. A method as claimed in claim 1 wherein the repetition rate and duty cycle of said time-varying rectangular wave are controlled by the combination of a direct digital synthesiser and a comparator.

4. A method as claimed in claim 1 including fixing one of the repetition rate of said time-varying rectangular wave and the excitation frequency of said time-varying dipole excitation voltage and scanning another of said repetition rate and said excitation frequency whereby to vary sequentially the mass-to-change ratio of ions undergoing said resonant oscillatory motion.

5. A method as claimed in claim 1 wherein the repetition rate of said time-varying rectangular wave voltage and the excitation frequency of said time-varying dipole excitation voltage have a fixed relationship and including scanning said repetition rate and said excitation frequency through a predetermined range whereby sequentially to cause ions having different mass-to-change ratios to undergo resonant oscillatory motion.

6. A method as claimed in claim 1 wherein said time-varying rectangular wave voltage is a frequency-variable square wave voltage.

7. A method as claimed in claim 1 wherein said time-varying rectangular wave voltage has a DC offset.

8. A method as claimed in claim 1 wherein said quadrupole ion trap device is an ion trap device capable of generating a 3-D quadrupole electric field.

9. A method as claimed in claim 1 wherein said quadrupole ion trap device is an ion trap device capable of generating a 3-D quadrupole electric field and higher order multiple electric fields.

10. A method as claimed in claim 1 wherein said quadrupole ion trap device is a linear quadrupole ion trap device.

11. A method as claimed in claim 1 wherein said resonant oscillatory motion is capable of causing selective ejection of ions from said quadrupole ion trap device for detection by an external detector.

12. A method as claimed in claim 1 wherein said resonant oscillatory motion is capable of increasing the kinetic energy of ions trapped by the quadrupole ion trap device.

13. A method as claimed in claim 1 wherein said time-varying dipole excitation voltage has multi-frequency components and is capable of exciting ions within a mass range and inducing image current for image current detection.

14. A method as claimed in claim 1 wherein said time-varying dipole excitation voltage has a rectangular waveform and is also generated by controlling switches.

15. A method as claimed in claim 5 wherein said fixed relationship is that said excitation frequency is proportional to said repetition rate, and is achieved by a frequency divider.

16. An apparatus for driving a quadrupole ion trap device comprising, means for creating a digital signal, a set of switches arranged to be controlled by said digital signal causing the switches alternately to switch between a high voltage level and a low voltage level to generate a time-varying rectangular wave voltage which is supplied, in use, to said quadrupole ion trap device for trapping ions in a predetermined range of mass-to-charge ratio, means for varying said digital signal to vary the predetermined range of mass-to charge ratio of ions that can be trapped by the quadrupole ion trap device and means for supplying to the quadrupole ion trap device a time-varying dipole excitation voltage to cause mass-selective resonant oscillatory motion of ions in the device.

17. An apparatus as claimed in claim 16 wherein said means for creating a digital signal includes means for generating clock pulses, means for counting the clock pulses and means for causing said switching when the count of pulses reaches respective preset values.

18. An apparatus as claimed in claim 16 wherein the repetition rate and duty cycle of said time-varying rectangular wave are controlled by control means including a direct digital synthesiser and a comparator.

19. An apparatus as claimed in claim 16 including means for fixing one of the repetition rate of said time-varying rectangular wave and the excitation frequency of said time-varying dipole excitation voltage and scanning another of said repetition rate and said excitation frequency whereby to vary sequentially the mass-to-charge ratio of ions undergoing said resonant oscillatory motion.

20. An apparatus as claimed in claim 16 wherein the repetition rate of said time-varying rectangular wave voltage and the excitation frequency of said time-varying dipole excitation voltage have a fixed relationship and including means for scanning said repetition rate and said excitation voltage through a predetermined range whereby sequentially to cause ions having different mass-to-charge ratios to undergo said resonant oscillatory motion.

21. An apparatus as claimed in claim 16 wherein said time-varying rectangular wave voltage is a frequency-variable square wave voltage.

22. An apparatus as claimed in claim 16 wherein said time-varying rectangular wave voltage has a DC offset.

23. An apparatus as claimed in claim 16 wherein said resonant oscillatory motion is capable of causing selective ejection of ions from said quadrupole ion trap device for detection by an external detector.

24. An apparatus as claimed in claim 16 wherein said resonant oscillatory motion is capable of increasing kinetic energy of ions trapped by the quadrupole ion trap device.

25. An apparatus as claimed in claim 16 wherein said time-varying dipole excitation voltage has multi-frequency components and is capable of exciting ions within a mass range and induce image current for image current detection.

26. An apparatus as claimed in claim 16 wherein said time-varying dipole excitation voltage has a rectangular waveform and is also generated by controlling switches.

27. An apparatus as claimed in claim 20 including a frequency divider for establishing said fixed relationship by maintaining said excitation frequency and said repetition rate in a fixed proportion.

28. A quadrupole ion trap device incorporating an apparatus as claimed in claim 16.

29. A quadrupole ion trap device as claimed in claim 28 being a 3D rotationally symmetric quadrupole ion trap device.

30. A quadrupole ion trap device as claimed in claim 28 being a linear quadrupole ion trap device.

* * * * *

UNITED STATES PATENT AND TRADEMARK OFFICE

CERTIFICATE OF CORRECTION

PATENT NO. : 7,193,207 B1
APPLICATION NO. : 10/089963
DATED : March 20, 2007
INVENTOR(S) : Li Ding and James Edward Nuttall It is certified that error appears in the above-identified patent and that said Letters Patent is hereby corrected as shown below:

On Title Page Item 73 should read (73)Assignee: Shimadzu Research Laboratory (Europe) Ltd.,
Manchester (GB)

Signed and Sealed this

Eighteenth Day of March, 2008

JON W. DUDAS
*Director of the United States Patent and Trademark Office*